US006234103B1

(12) United States Patent
Emrich

(10) Patent No.: US 6,234,103 B1
(45) Date of Patent: May 22, 2001

(54) RAMP UNIT FOR FLOATING PONTOONS

(75) Inventor: Lothar Emrich, Rehweiler (DE)

(73) Assignee: EWK Eisenwerke Kaiserlauten GmbH, Kaiserslautern (DE)

( * ) Notice: Subject to any disclaimer, the term of this patent is extended or adjusted under 35 U.S.C. 154(b) by 0 days.

(21) Appl. No.: 09/543,455

(22) Filed: Apr. 5, 2000

(30) Foreign Application Priority Data

Apr. 6, 1999 (DE) ..... 199 15 353

(51) Int. Cl.[7] ..... B63B 35/44
(52) U.S. Cl. ..... 114/266; 14/2.6
(58) Field of Search ..... 114/266, 267; 14/2.6

(56) References Cited

U.S. PATENT DOCUMENTS 3,682,126 * 8/1972 Wagner et al. ..... 14/2.6
4,386,441 * 6/1983 Lundholm ..... 14/2.6

* cited by examiner

*Primary Examiner*—Ed Swinehart
(74) *Attorney, Agent, or Firm*—Friedrich Kueffner

(57) ABSTRACT

A ramp unit for pontoon structures has two inner float bodies, each having an upper deck and a lower deck, and connecting hinges pivotally connecting the two inner float bodies to one another. Two outer float bodies each having an upper deck and a lower deck are connected respectively by double-jointed hinges to the two inner float bodies at a side of the two inner float bodies opposite the connecting hinges. A folding and unfolding mechanism folds the two inner and the two outer float bodies into a folded W-shape for transport and unfolds the W-shape into a stretched operating position in which the upper decks of the two inner and the two outer float bodies form a planar driving deck. Portions of each one of the lower decks of the two inner and the two outer float bodies are planar in a longitudinal direction of each of the two inner and the outer float bodies over the entire length thereof. The double-jointed hinges are arranged and configured such that in the folded W-shape the planar portions of the lower decks of the two outer float bodies are positioned parallel to one another.

21 Claims, 3 Drawing Sheets

RAMP UNIT FOR FLOATING PONTOONS

BACKGROUND OF THE INVENTION

1. Field of the Invention

The invention relates to ramp units for floating pontoons that can be folded into a W-shape and are combined to form floating bridges (pontoon bridges) or ferries. The ramp unit comprises essentially two inner float bodies, two outer float bodies, connecting hinges between the inner float bodies, double-jointed hinges between the inner and outer float bodies, and a folding and unfolding mechanism. The driving deck formed by the upper decks of the inner and outer float bodies is planar.

2. Description of the Related Art

Floating pontoons with two inner and two outer float bodies, which are folded into a W-shape in the transport position, float on the water and provide a driving deck in their operating position, have raised sidewalks and, optionally, raised wash plates, have been known for a long time. Originally developed by the Soviet army, they are currently widely used in many Western armies. The transport of the individual floating pontoons is carried out by means of trucks. The loading surface of the trucks is provided with four rolls on which the pontoon is rolled into the water. For returning the pontoon from the water onto the truck, a hydraulically actuated crane is provided.

The folding and unfolding of the floating pontoons is realized essentially by a suitable distribution of the gravity and buoyancy centers of the inner and outer float bodies and is assisted by a folding and unfolding mechanism comprised of levers and cable pulls.

For assembling ferries and floating bridges, several floating pontoons are coupled to one another. Their ends are provided with special ramp units having a height which tapers in a wedge shape in the direction toward the bank so that vehicles can drive onto the ferry or floating bridge more easily. These ramp units are the object of the present invention.

A ramp unit has been known for some time now in the prior art in which the height reduction is achieved in that the upper deck of the inner and outer float bodies forming the driving deck is angled downwardly. Movable ramp plates or stationary tapered ramp edges are provided as drive-up aids for vehicles at the front end of the ramp unit. The lower decks of the ramp unit are unchanged. When the lower deck of the ramp unit rests on the bank or shore of a body of water, a relatively steep angle between the upper deck of the ramp unit and the upper deck of the adjacently positioned floating pontoon results. Vehicles whose chassis is not specially adapted can thus be damaged when driving across this angled driving deck area. Even all-terrain vehicles must drive at reduced speed across this angled driving deck, and this results in a reduction of the vehicle transfer rate of the pontoon bridge or ferry.

In addition to the above described older floating pontoon system, a more recent system is known in which the upper deck of the ramp unit is without angled portion, i.e., is planar over its entire length. Instead, the lower deck is angled. However, this causes several significant disadvantages.

A first disadvantage is that, when used on a flat bank, the lower angled edge rests on the bank, while the leading end of the ramp is exposed and freely suspended in the air. Accordingly, driving onto the ramp is difficult for vehicles. Furthermore, the freely exposed ramp end provides leverage which transmits the weight of a vehicle driving onto the ramp so unfavorably onto the adjacently positioned floating pontoon that the latching parts provided thereat can be overloaded.

A further disadvantage becomes apparent when the ramp unit is placed onto the truck in the transport position. Due to the angled edge at the lower deck the outer contours taper toward the leading ramp end. This configuration prevents the transport of such ramp units on standard trucks because they are only provided with four rollers. In order to be able to transport such ramp units, the trucks must be provided with additional auxiliary rolls. This is unsatisfactory.

The third disadvantage also becomes apparent in the folded transport state of the ramp unit on the transport truck. The transport latching devices provided for securing the standard floating pontoons on the truck during transport cannot be used because they cannot reach the tapered outer floating body. It is therefore necessary to provide an additional latching mechanism. This is also extremely unsatisfactory.

SUMMARY OF THE INVENTION

It is an object of the present invention to provide a ramp unit for floating pontoons that are foldable into a W-shape, can be transported on the same type of transport truck as standard floating pontoons, and reliably prevent overloading of the upper latching mechanism between the ramp unit and the adjacently positioned floating pontoon.

In accordance with the present invention, this is achieved in that the lower decks of the inner and outer float bodies have planar portions extending over the entire length thereof and in that the double-jointed hinges between the inner and outer float bodies are dimensioned and arranged such that in the folded state the planar portions of the lower decks of the outer float bodies are positioned parallel to one another.

Owing to the planar configuration of the lower deck of the inner and outer float bodies, the lower decks will rest flat on bank, even on a flat bank, over their entire length. The vehicles driving onto the ramp unit therefore cannot generate any forces which load the latching elements at the adjoining standard floating pontoon. Due to the continuous slant of the upper deck relative to the lower deck over the complete length of the upper deck, preferably in the range of 4 to 5°, the driving deck angle between the upper deck of the ramp unit and the upper deck of the adjoining floating pontoon is reduced so that even for steep banks a higher driving speed and thus a higher vehicle transfer rate can be achieved. Also, it has been found that forces resulting from driving of the vehicles onto the ramp unit are more favorably transmitted onto the adjoining floating pontoon by the ramp unit resting with one end on land.

The decisive advantage of the present invention is however that the planar portions of the lower decks of the outer float body extend parallel to one another over the entire length in the transport position on the transport truck. With this measure, the ramp unit according to the invention can be transported on standard trucks, launched into the water, returned onto the standard truck, and secured on the standard truck. Auxiliary rolls and auxiliary latches are not needed.

This is achieved by employing special double-jointed hinges. The basic principle of a double-jointed hinge connection is the subject matter of German patent application 198 51 346. These known double-jointed hinges had to be adapted to a small degree for use in the ramp unit according to the invention. These changes are substantially caused by the wedge-shape of the inner and outer float bodies and the exact parallelism of the lower decks of the outer float bodies in the transport state.

According to a first embodiment, the two double-jointed hinges pivotably connecting one inner float body and one outer float body to one another have different lengths. According to a further embodiment, the bearing portions of the double-jointed hinges are slightly angled. This is a preventive measure against jamming of the hinges.

According to a second embodiment, the two double-jointed hinges connecting one inner float body and one outer float body pivotably to one another have the same length. This configuration provides for a simpler bearing and hinge design but requires a greater material expenditure.

Preferably, the double-jointed hinges for pivotably connecting one inner float body and one outer float body are connected to one another via a torsion-proof rod and are in operative connection with the folding and unfolding mechanism. This configuration is already disclosed in the German published patent application 198 51 346. Reference is being had to this publication for details on this configuration.

As is known in principle, the inner float bodies of the ramp unit according to the invention can be provided at their leading (front) ends with stationary or movable ramp edges.

According to one configuration, the outer float body has at its leading or front end foldable ramp plates. These are folded during transport toward the inner float bodies. This reduces to a minimum the required free space behind the transport vehicle. Furthermore, the plates provide a braking function during launching into the water and reduce considerably the launching speed. This reduces the dynamic immersion depth.

The feature of providing the outer float bodies along their longitudinal outer side with a raised sidewalk is known in principle. Such raised sidewalks can be used in connection with the ramp unit according to the invention. Also known are raised wash plates for use on the outer float bodies which can also be used in connection with the ramp unit according to the invention. Such wash plates can simultaneously act as a border member for the sidewalk.

DESCRIPTION OF THE PREFERRED EMBODIMENTS

Figure 1:
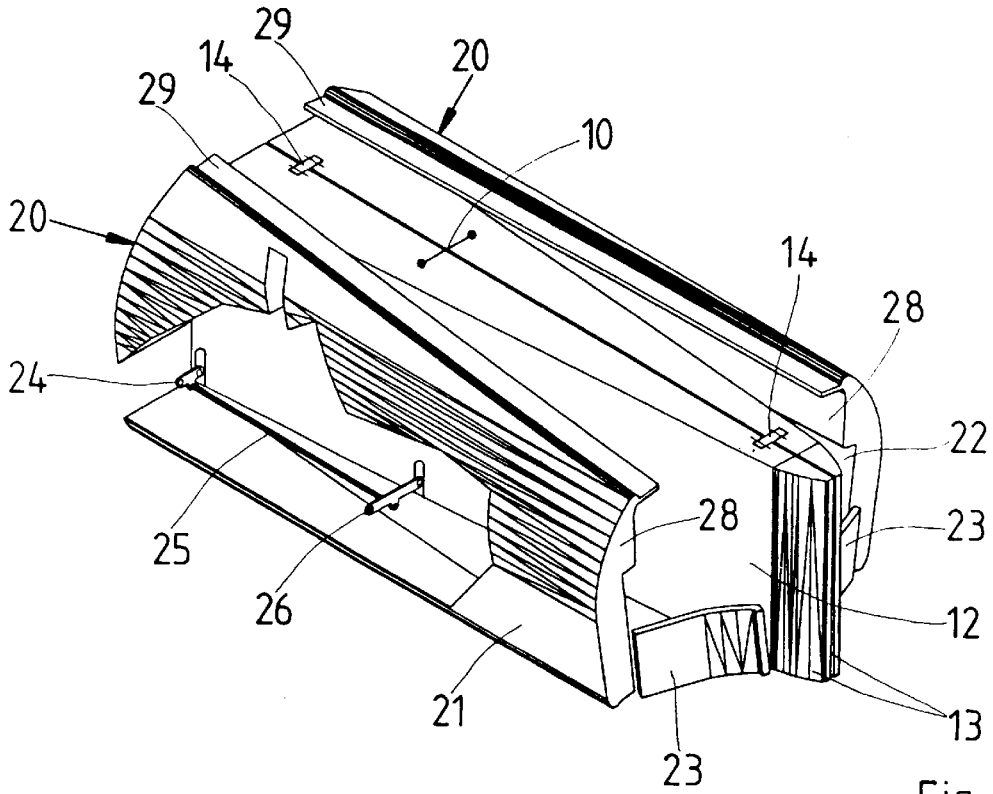
FIG. 1 is a perspective illustration of a first ramp unit according to the present invention in the folded transport position.

The perspective representation of FIG. 1 shows a first ramp unit in its folded transport position. Two inner float bodies 10 are shown which are pivotably connected to one another by connecting hinges 14. Two outer float bodies 20 are also shown which are pivotably connected to the inner float bodies 10, respectively, by double-jointed hinges 24, 26 which are coupled to one another by a torsion-proof rod 25. In the folded transport position the lower decks 11 of the inner float bodies 10 rest against one another. The upper decks 12, 22 of the inner and outer float bodies 10, 20 face one another.

Portions of the lower decks 21 of the two outer float bodies 20 are planar over their entire length. Furthermore, the lower decks 21 extend parallel to one another in the transport position. Further details may be taken from FIG. 3.

At the front or leading end of the inner float body 10 stationary tapered ramp edges 13 are provided and at the front end of the outer float bodies 20 movable ramp plates 23 are provided. The ramp edges 13 and the ramp plates 23 serve as driving aids for driving vehicles onto the ramp unit.

Figure 2:
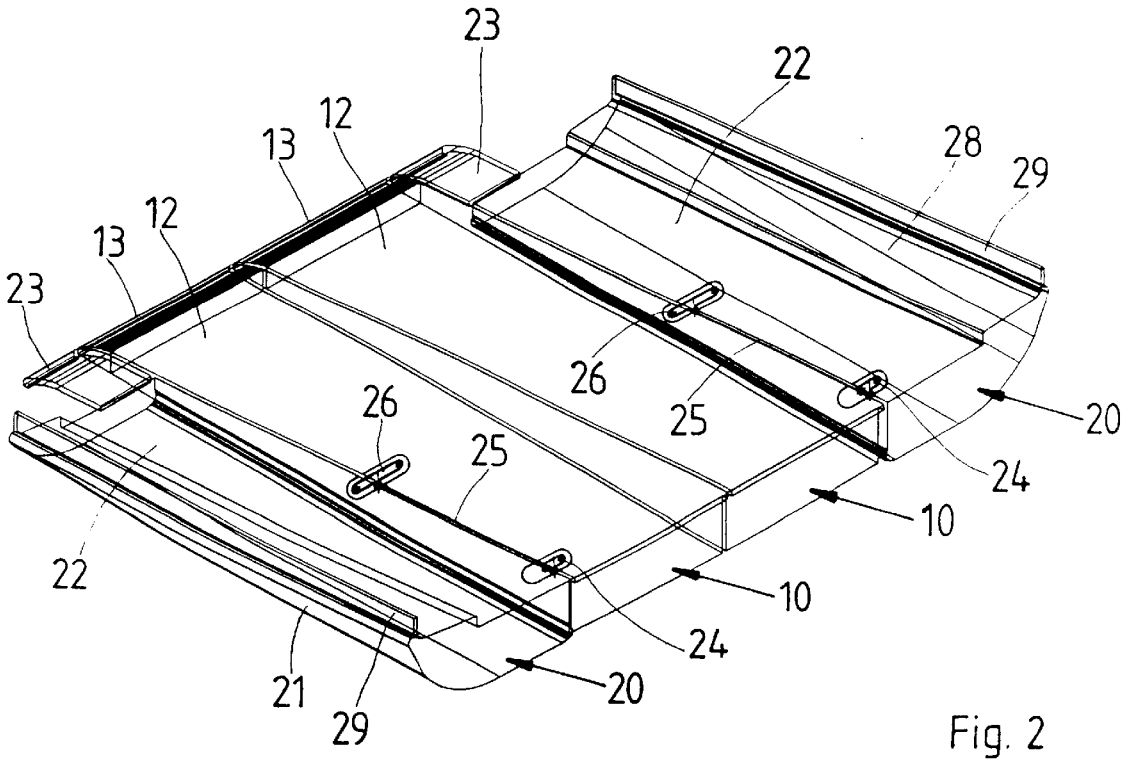
FIG. 2 is a perspective illustration of the ramp unit of FIG. 1 in the unfolded operating position.

FIG. 2 shows the ramp unit of FIG. 1 in the unfolded (stretched) operating position. The upper decks 12 of the inner float bodies 10 are planar over their entire length and are slanted forwardly and downwardly relative to the lower decks 11, preferably at an angle of 4 to 5°. The same configuration is provided for the lower and upper decks 21, 22 of the outer float bodies 20. In this way, the lower decks 11, 21 of the ramp unit are aligned with the lower decks of the adjoining standard floating pontoon (not shown) coupled to the ramp unit. The outer sides of the outer float bodies 20 have raised sidewalks 28 and longitudinal outer wash plates 29 acting as border members by extending upwardly from the walking surface of the sidewalks.

The brackets of the double-jointed hinges 24, 26 have different lengths. The double-jointed hinges and their bearing locations are dimensioned and arranged within the inner and outer float bodies 10, 20 such that the lower decks 21 of the outer float bodies 20 are positioned parallel to one another in the transport state, as shown in FIG. 1, and that in the unfolded operating state of FIG. 2 the upper decks 12, 22 of inner and outer float bodies 10, 20 are positioned at the same level and have only a small gap therebetween.

The unfolding and folding mechanism which is always present in practical embodiments is not shown in the drawing in order not to overcrowd the drawing and take away from the features of the invention.

Figure 3:
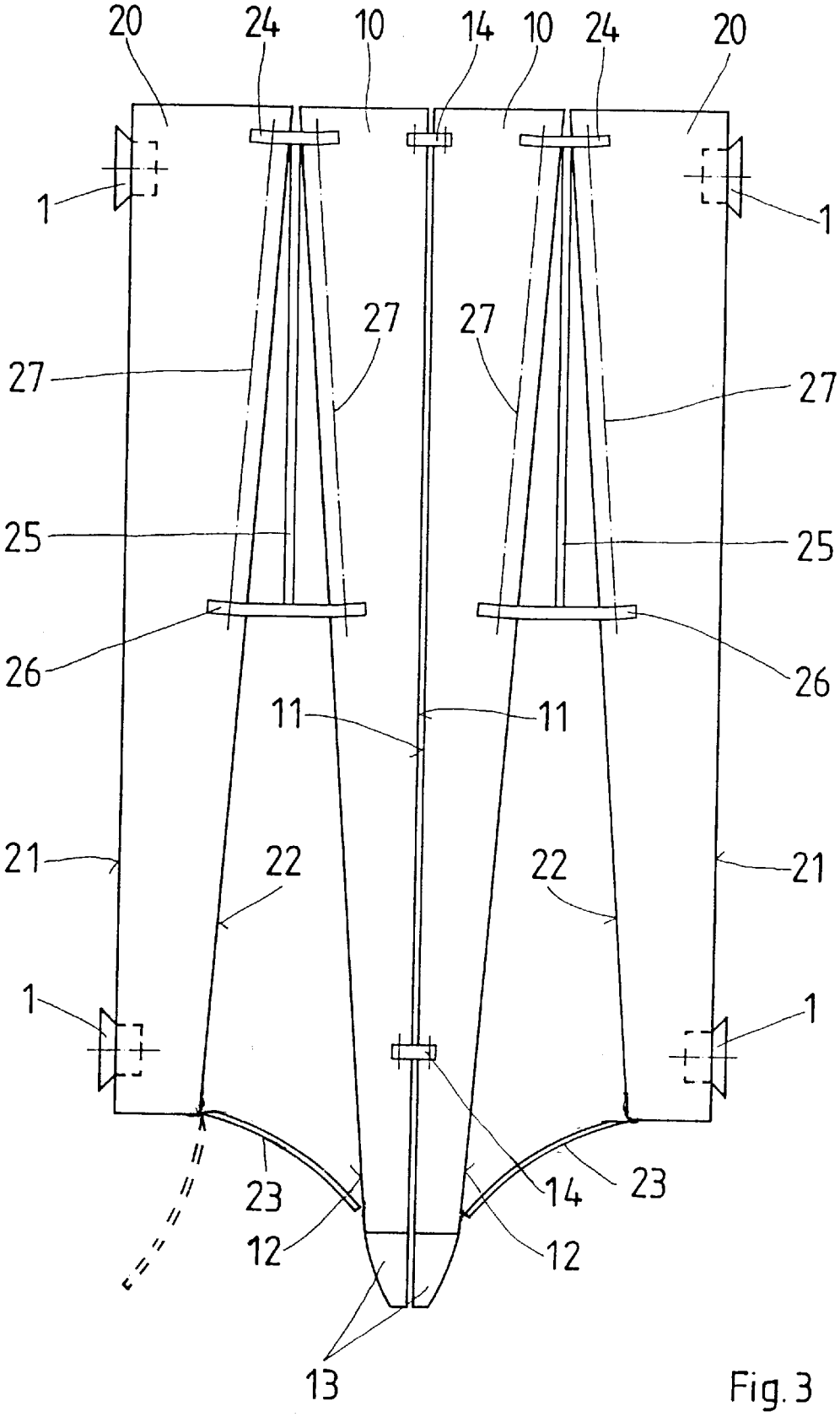
FIG. 3 is a plan view onto the top side of the ramp unit of FIG. 1.

FIG. 3 shows a view from above onto the ramp unit of FIG. 1. The two inner float bodies 10, whose lower decks 11 rest against one another, and the two outer float bodies 20, whose lower decks 21 extend parallel to one another, can be clearly seen. Also illustrated are the double-jointed hinges 24, 26 connecting the inner and the outer float bodies 10, 20. The different bracket lengths and the torsion-proof rod 21 connecting the double-jointed hinges 24, 26 are also shown. The bearing portions of the double-jointed hinges 24, 26 are angled, corresponding to the axes 27 connecting the bearings of the two double-jointed hinges 24, 26. These connecting axes 27 extend essentially parallel to the upper decks 12, 22 of the inner and outer float bodies 10, 20.

Due to the fact that the lower decks 21 of the outer float bodies 20 are positioned parallel to one another in the shown transport position, the ramp unit according to the invention rests on rolls 1 (FIG. 3) of standard transport devices (not shown). Special auxiliary rolls required in the prior art are not needed.

Figure 4:
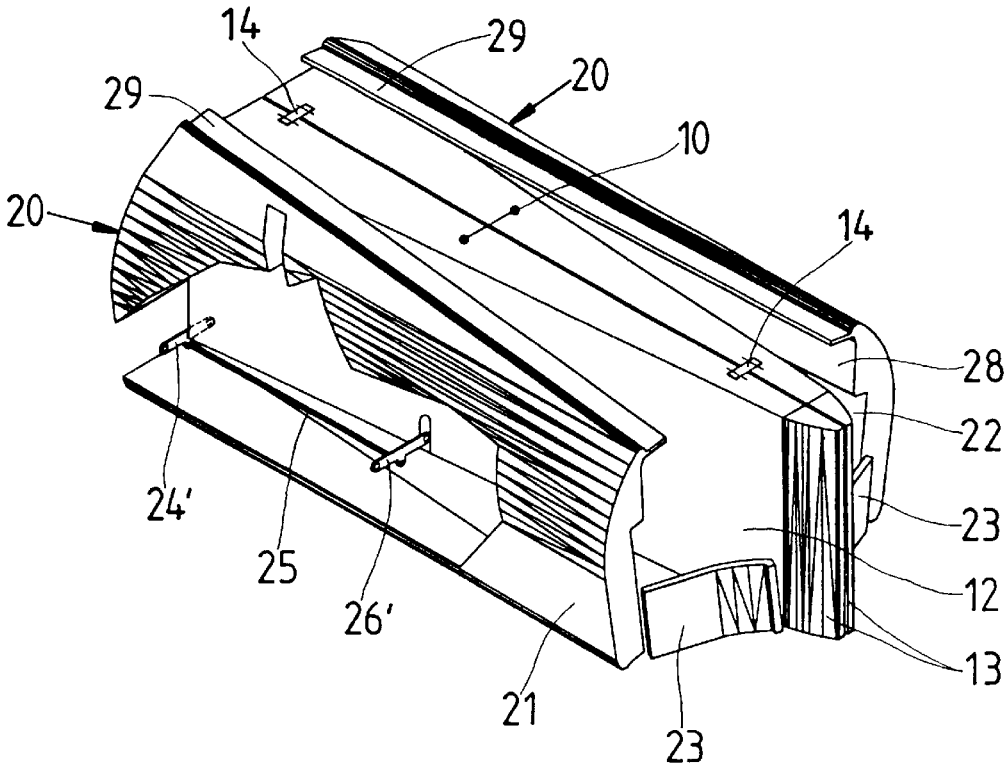
FIG. 4 is a perspective illustration of a second ramp unit according to the present invention in the folded transport position.
Figure 5:
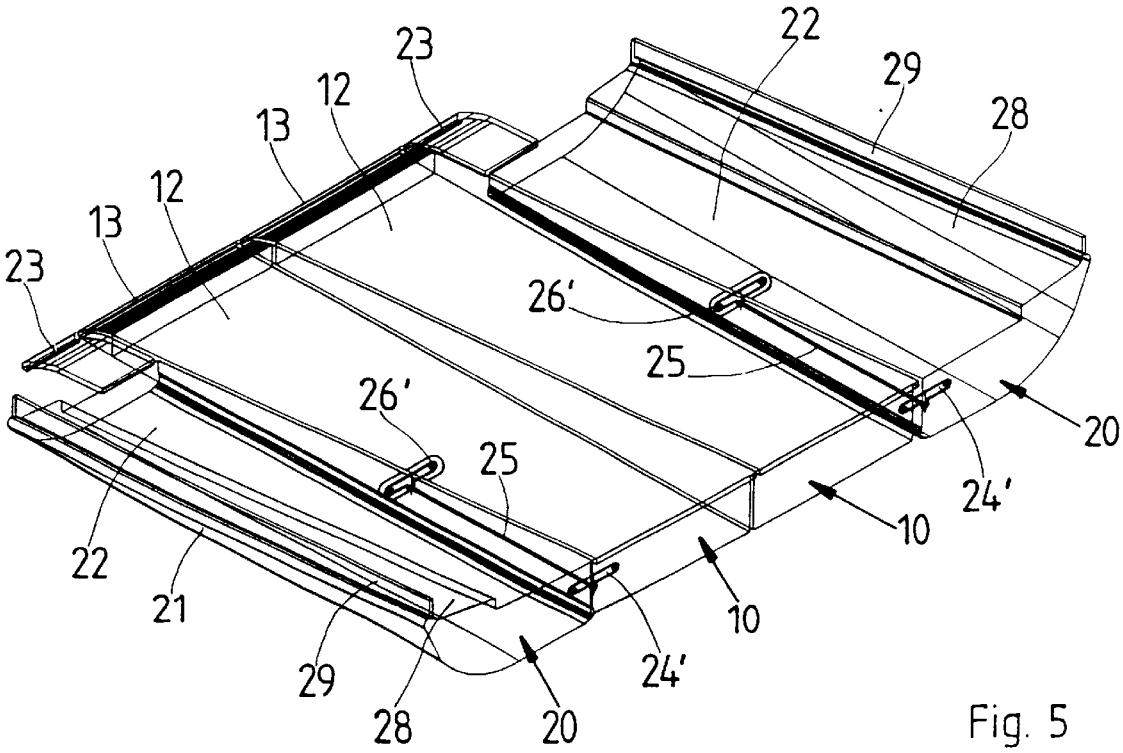
FIG. 5 is a perspective representation of the ramp unit of FIG. 4 in the unfolded operating position.

FIGS. 4 and 5 show a slightly modified ramp unit. The double-jointed hinges 24', 26' have the same bracket length in this embodiment. In order for this to be possible, the double-jointed hinges 24' at the ends must be freely exposed so that they are less protected than the double-jointed hinges 24, 26; 26' which are positioned in the interior of the inner and outer float bodies 10, 20 and are thus arranged at a protected location.

While specific embodiments of the invention have been shown and described in detail to illustrate the inventive principles, it will be understood that the invention may be embodied otherwise without departing from such principles.

What is claimed is:

1. A ramp unit for pontoon structures, said ramp unit comprising:

two inner float bodies each having an upper deck and a lower deck;

connecting hinges configured to pivotally connect the two inner float bodies to one another;

two outer float bodies each having an upper deck and a lower deck;

double-jointed hinges configured to pivotally connect each one of the outer float bodies to one of the two inner float bodies at a side of the two inner float bodies opposite the connecting hinges;

a folding and unfolding mechanism configured to fold the two inner and the two outer float bodies into a folded W-shape for transport and unfold the W-shape of the two inner and the two outer float bodies into a stretched operating position;

wherein in the stretched operating position the upper decks of the two inner and the two outer float bodies form a planar driving deck;

wherein portions of each one of the lower decks of the two inner and the two outer float bodies are planar in a longitudinal direction of each of the two inner and the outer float bodies over the entire length thereof;

wherein the double-jointed hinges are arranged and configured such that in the folded W-shape the planar portions of the lower decks of the two outer float bodies are positioned parallel to one another;

wherein the two inner and the two outer float bodies taper in the longitudinal direction of each of the two inner and the outer float bodies so as to have a thick end and a thin end;

wherein first ones of the double-jointed hinges have a greater length than second ones of the double-jointed hinges and wherein the second double-jointed hinges are positioned adjacent to the thick end and the first double-jointed hinges are positioned remote from the thick end.

2. The ramp unit according to claim 1, wherein the double-jointed hinges have suitably angled bearing portions, wherein the bearing portions of the double-jointed hinges are angled corresponding to the axes connecting the bearings of the first and second double-jointed hinges to one another, respectively.

3. The ramp unit according to claim 1, further comprising a torsion-proof rod configured to connect the double-jointed hinges to one another, wherein the double jointed hinges are operatively connected to the folding and unfolding mechanism.

4. The ramp unit according to claim 1, wherein the two inner float bodies have stationary or moveable tapered ramp edges at a front side thereof.

5. The ramp unit according to claim 1, wherein the two outer float bodies have foldable ramp plates at a front side thereof.

6. The ramp unit according to claim 5, wherein the foldable ramp plates are configured such that, during transport of the ramp unit and during launching into water, the foldable ramp plates are folded toward the two inner float bodies.

7. The ramp unit according to claim 1, wherein the two outer float bodies each have a longitudinal sidewalk portion that is raised above the planar driving deck and is located distal to the two inner float bodies.

8. The ramp unit according to claim 7, wherein each of the sidewalk portions has a longitudinal outer wash plate extending upwardly from a walking surface of the sidewalk portion and forming an outer border member.

9. The ramp unit according to claim 1, wherein the outer float bodies each have a longitudinal outer wash plate extending upwardly relative to the upper deck.

10. The ramp unit according to claim 1, wherein the upper decks are downwardly slanted in the longitudinal direction toward a front end thereof at a slant angle of 4° to 5° relative to the lower decks.

11. A ramp unit for pontoon structures, said ramp unit comprising:

two inner float bodies each having an upper deck and a lower deck;

connecting hinges configured to pivotally connect the two inner float bodies to one another;

two outer float bodies each having an upper deck and a lower deck;

double-jointed hinges configured to pivotally connect each one of the outer float bodies to one of the two inner float bodies at a side of the two inner float bodies opposite the connecting hinges;

a folding and unfolding mechanism configured to fold the two inner and the two outer float bodies into a folded W-shape for transport and unfold the W-shape of the two inner and the two outer float bodies into a stretched operating position;

wherein in the stretched operating position the upper decks of the two inner and the two outer float bodies form a planar driving deck;

wherein portions of each one of the lower decks of the two inner and the two outer float bodies are planar in a longitudinal direction of each of the two inner and the outer float bodies over the entire length thereof;

wherein the double-jointed hinges are arranged and configured such that in the folded W-shape the planar portions of the lower decks of the two outer float bodies are positioned parallel to one another;

wherein the two inner and the two outer float bodies taper in the longitudinal direction of each of the two inner and the outer float bodies so as to have a thick end and a thin end;

wherein the double-jointed hinges each have an identical length, wherein first ones of the double-jointed hinges are positioned adjacent to the thick end and second ones of the double-jointed hinges are positioned remote from the thick end;

wherein the first double-jointed hinges are positioned at a greater distance below the upper decks of the inner and outer float bodies than the second double-jointed hinges.

12. The ramp unit according to claim 11, further comprising a torsion-proof rod configured to connect the double-jointed hinges to one another, wherein the double jointed hinges are operatively connected to the folding and unfolding mechanism.

13. The ramp unit according to claim 11, wherein the two inner float bodies have stationary or moveable tapered ramp edges at a front side thereof.

14. The ramp unit according to claim 11, wherein the two outer float bodies have foldable ramp plates at a front side thereof.

15. The ramp unit according to claim 14, wherein the foldable ramp plates are configured such that, during transport of the ramp unit and during launching into water, the foldable ramp plates are folded toward the two inner float bodies.

16. The ramp unit according to claim 11, wherein the two outer float bodies each have a longitudinal sidewalk portion that is raised above the planar driving deck and is located distal to the two inner float bodies.

17. The ramp unit according to claim 16, wherein each of the sidewalk portions has a longitudinal outer wash plate extending upwardly from a walking surface of the sidewalk portion and forming an outer border member.

18. The ramp unit according to claim 11, wherein the outer float bodies each have a longitudinal outer wash plate extending upwardly relative to the upper deck.

19. The ramp unit according to claim 11, wherein the upper decks are downwardly slanted in the longitudinal direction toward a front end thereof at a slant angle of 4° to 5° relative to the lower decks.

20. A ramp unit for pontoon structures, said ramp unit comprising:

two inner float bodies each having an upper deck and a lower deck;

connecting hinges configured to pivotally connect the two inner float bodies to one another;

two outer float bodies each having an upper deck and a lower deck;

double-jointed hinges configured to pivotally connect each one of the outer float bodies to one of the two inner float bodies at a side of the two inner float bodies opposite the connecting hinges;

a folding and unfolding mechanism configured to fold the two inner and the two outer float bodies into a folded W-shape for transport and unfold the W-shape of the two inner and the two outer float bodies into a stretched operating position;

wherein in the stretched operating position the upper decks of the two inner and the two outer float bodies form a planar driving deck;

wherein portions of each one of the lower decks of the two inner and the two outer float bodies are planar in a longitudinal direction of each of the two inner and the outer float bodies over the entire length thereof;

wherein the double-jointed hinges are arranged and configured such that in the folded W-shape the planar portions of the lower decks of the two outer float bodies are positioned parallel to one another;

wherein the two inner and the two outer float bodies taper in the longitudinal direction of each of the two inner and the outer float bodies so as to have a thick end and a thin end;

wherein first ones of the double-jointed hinges have a greater length than second ones of the double jointed hinges and wherein the second double-jointed hinges are positioned adjacent to the thick end and the first double-jointed hinges are positioned remote from the thick end;

torsion-proof rods configured to connect the first and second double-jointed hinges to one another, respectively.

21. A ramp unit for pontoon structures, said ramp unit comprising:

two inner float bodies each having an upper deck and a lower deck;

connecting hinges configured to pivotally connect the two inner float bodies to one another;

two outer float bodies each having an upper deck and a lower deck;

double-jointed hinges configured to pivotally connect each one of the outer float bodies to one of the two inner float bodies at a side of the two inner float bodies opposite the connecting hinges;

a folding and unfolding mechanism configured to fold the two inner and the two outer float bodies into a folded W-shape for transport and unfold the W-shape of the two inner and the two outer float bodies into a stretched operating position;

wherein in the stretched operating position the upper decks of the two inner and the two outer float bodies form a planar driving deck;

wherein portions of each one of the lower decks of the two inner and the two outer float bodies are planar in a longitudinal direction of each of the two inner and the outer float bodies over the entire length thereof;

wherein the double-jointed hinges are arranged and configured such that in the folded W-shape the planar portions of the lower decks of the two outer float bodies are positioned parallel to one another;

wherein the two inner and the two outer float bodies taper in the longitudinal direction of each of the two inner and the outer float bodies so as to have a thick end and a thin end;

wherein the double-jointed hinges each have an identical length, wherein first ones of the double-jointed hinges are positioned adjacent to the thick end and second ones of the double-jointed hinges are positioned remote from the thick end;

wherein the first double-jointed hinges are positioned at a greater distance below the upper decks of the inner and outer float bodies than the second double-jointed hinges;

torsion-proof rods configured to connect the first and second double-jointed hinges to one another, respectively.

* * * * *